US009541875B2

(12) United States Patent
Sugaya et al.

(10) Patent No.: US 9,541,875 B2
(45) Date of Patent: Jan. 10, 2017

(54) IMAGE FORMING APPARATUS AND SHEET STORAGE DEVICE

(71) Applicant: CANON KABUSHIKI KAISHA, Tokyo (JP)

(72) Inventors: Hajime Sugaya, Susono (JP); Mitsuhiro Ito, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/803,642

(22) Filed: Jul. 20, 2015

(65) Prior Publication Data

US 2016/0026136 A1 Jan. 28, 2016

(30) Foreign Application Priority Data

Jul. 23, 2014 (JP) ..... 2014-149482

(51) Int. Cl.
*G03G 15/00* (2006.01)
*B41J 13/00* (2006.01)
(Continued)

(52) U.S. Cl.
CPC ..... *G03G 15/50* (2013.01); *B41J 13/0036* (2013.01); *B65H 31/24* (2013.01); *B65H 31/3081* (2013.01); *B65H 39/115* (2013.01); *G03G 15/6538* (2013.01); *B65H 2301/42194* (2013.01); *B65H 2301/44342* (2013.01); *B65H 2402/443* (2013.01); *B65H 2405/332* (2013.01);
(Continued)

(58) Field of Classification Search
CPC ..... G03G 15/6538; G03G 15/6552; G03G 15/6555; G03G 15/5091; G03G 15/6547
See application file for complete search history.

(56) References Cited

U.S. PATENT DOCUMENTS

2004/0085565 A1* 5/2004 Owen ..... G06Q 10/06 358/1.14
2009/0041482 A1* 2/2009 Inenaga ..... G03G 15/6547 399/23
(Continued)

FOREIGN PATENT DOCUMENTS

JP 2001-154818 A 6/2001
JP 2013-220905 A 10/2013
(Continued)

*Primary Examiner* — David Gray
*Assistant Examiner* — Tyler Hardman
(74) *Attorney, Agent, or Firm* — Canon U.S.A., Inc. IP Division

(57) ABSTRACT

In an image forming apparatus including an apparatus body, an image forming portion, a conveyance unit, a storage portion, a sheet movement unit, a memory portion, and a control portion, in a case where an image forming instruction to perform image formation on a sheet has been received, the control portion provides notification of a plurality of discharging methods of storing the sheet which is an object of the image forming instruction, into the storage portion and then exposing the sheet outside of the apparatus body via an opening of the storage portion, based on first information stored in the memory portion and second information about the sheet which is an object of the image forming instruction, and controls the conveyance unit and the sheet movement unit based on a discharging method selected from among the plurality of discharging methods.

9 Claims, 15 Drawing Sheets

DISTRIBUTION OF SHEETS

DISCHARGING OF SHEETS

(51) Int. Cl.
*B65H 31/24* (2006.01)
*B65H 31/30* (2006.01)
*B65H 39/115* (2006.01)

(52) U.S. Cl.
CPC ..... *B65H 2408/111* (2013.01); *B65H 2408/13* (2013.01); *B65H 2701/1822* (2013.01); *B65H 2801/06* (2013.01); *G03G 15/5091* (2013.01); *G03G 15/6547* (2013.01); *G03G 15/6552* (2013.01); *G03G 15/6555* (2013.01); *G03G 2215/00299* (2013.01)

(56) References Cited

U.S. PATENT DOCUMENTS

2015/0078797 A1* 3/2015 Hirose ..... G03G 15/6552 399/405
2015/0086225 A1* 3/2015 Sugaya ..... G03G 15/50 399/23

FOREIGN PATENT DOCUMENTS

JP 2013220905 A * 10/2013
JP 2014-114164 A 6/2014

* cited by examiner

DISTRIBUTION OF SHEETS

DISCHARGING OF SHEETS

DISTRIBUTION OF SHEETS

DISCHARGING OF SHEETS

DISTRIBUTION OF SHEETS

DISCHARGING OF SHEETS

FIG. 10

| OPERATION SUGGESTION ID | ORDINAL NUMBER | SHEET STACK No. | EXPOSURE LENGTH | SHEET CONFIGURATION |
|---|---|---|---|---|
| Case1 | 1 | 1 | SMALL | USER B (THE FIRST COPY) |
| | | 2 | LARGE | USER B (THE SECOND COPY)<br>USER B (THE THIRD COPY) |
| Case2 | 1 | 1 | SMALL | USER B (THE FIRST COPY) |
| | | 2 | LARGE | USER B (THE SECOND COPY) |
| | 2 | 1 | LARGE | USER B (THE THIRD COPY) |
| Case3 | 1 | 1 | SMALL | USER B (THE FIRST COPY) |
| | | 2 | MEDIUM | USER B (THE SECOND COPY)<br>USER A (THE FIRST COPY) |
| | | 3 | LARGE | USER B (THE THIRD COPY) |

IMAGE FORMING APPARATUS AND SHEET STORAGE DEVICE

BACKGROUND

Field

Aspects of the present invention generally relate to an image forming apparatus and a sheet storage device each of which includes a storage portion configured to temporarily store an image-formed sheet inside a body of the apparatus.

Description of the Related Art

Some conventional image forming apparatuses, such as copying machines and printers, include a storage portion configured to temporarily store an image-formed sheet inside a body of the apparatus (the apparatus body).

Japanese Patent Application Laid-Open No. 2013-220905 discusses an image forming apparatus that includes, besides an ordinary discharge tray, which is located on the upper surface of the apparatus body and is usable in common by a plurality of users, a plurality of storage portions configured to temporarily store an image-formed sheet inside the apparatus body. In the discussed image forming apparatus, an opening configured to expose the sheet stored inside the apparatus body to outside the apparatus body is provided for each storage portion. The discussed image forming apparatus allows sheets to be stored into different storage portions for the respective users. Then, to take out a sheet stored in the associated storage portion, the user is required to perform user authentication using, for example, an identification card (ID card). The user authentication is performed by the user swiping the user's own ID card through an ID card reading unit mounted on the apparatus. When the user authentication has been successfully performed, the sheet which the user has issued an instruction to discharge is discharged to outside the apparatus body via the associated opening. This enables the user to take out only the user's own image-formed sheet.

Now, a case can be considered where a method of discharging even sheets for the same user after distributing and storing the sheets into different storage portions is more useful to improve usability than a method of discharging sheets after storing the sheets into different storage portions for the respective users as discussed in Japanese Patent Application Laid-Open No. 2013-220905.

For example, in a case where an instruction is issued to perform image formation of the same document with a plurality of copies, a method of discharging sheets after distributing and storing the sheets into different storage portions for the respective copies can more save the user's trouble of sorting a plurality of copies than a method of discharging sheets after collectively storing a plurality of sheets into a single storage portion.

However, in the case of, as mentioned above, distributing and storing sheets into different storage portions for the respective copies, if the number of copies is greater than the number of storage portions, a method of simply distributing and storing sheets into respective different storage portions cannot be adopted. Furthermore, in a case where, among a plurality of storage portions, there is a storage portion in which sheets have already been stored, it is necessary to take into consideration the relationship between the number of storage portions allowing sheets to be stored therein and the number of copies.

Thus, in order to improve usability, it is necessary to take into consideration the number of storage portions allowing sheets to be stored therein, the contents of an instruction for image formation, etc., to determine an executable sheet discharging method.

SUMMARY

Aspects of the present invention generally include an image forming apparatus and a sheet storage device each of which is capable of improving usability by notifying the user of executable sheet discharging methods and allowing the user to select a desired sheet discharging method from among the executable sheet discharging methods.

According to an aspect of the present invention, an image forming apparatus includes an apparatus body including an opening formed therein, an image forming portion configured to form an image on a sheet, a conveyance unit configured to convey the sheet having the image formed thereon, a storage portion configured to store the sheet conveyed by the conveyance unit inside the apparatus body, a sheet movement unit configured to move the sheet stored in the storage portion until the sheet is exposed outside of the apparatus body via the opening, a memory portion configured to store first information about a storing state of the storage portion, and a control portion configured to control the conveyance unit and the sheet movement unit, wherein in a case where an image forming instruction to perform image formation on a sheet has been received, the control portion provides notification of a plurality of discharging methods of storing the sheet which is an object of the image forming instruction, into the storage portion and then exposing the sheet outside of the apparatus body via the opening, based on the first information stored in the memory portion and second information about the sheet which is an object of the image forming instruction, and controls the conveyance unit and the sheet movement unit based on a discharging method selected from among the plurality of discharging methods.

Further features of the present disclosure will become apparent from the following description of exemplary embodiments with reference to the attached drawings.

BRIEF DESCRIPTION OF THE DRAWINGS

FIG. 10 illustrates a specific example indicating the contents of information about a plurality of sheet discharging methods according to the first exemplary embodiment.

DESCRIPTION OF THE EMBODIMENTS

Various exemplary embodiments, features, and aspects will be described in detail below with reference to the drawings.

(Configuration of Image Forming Apparatus)

Figure 1:
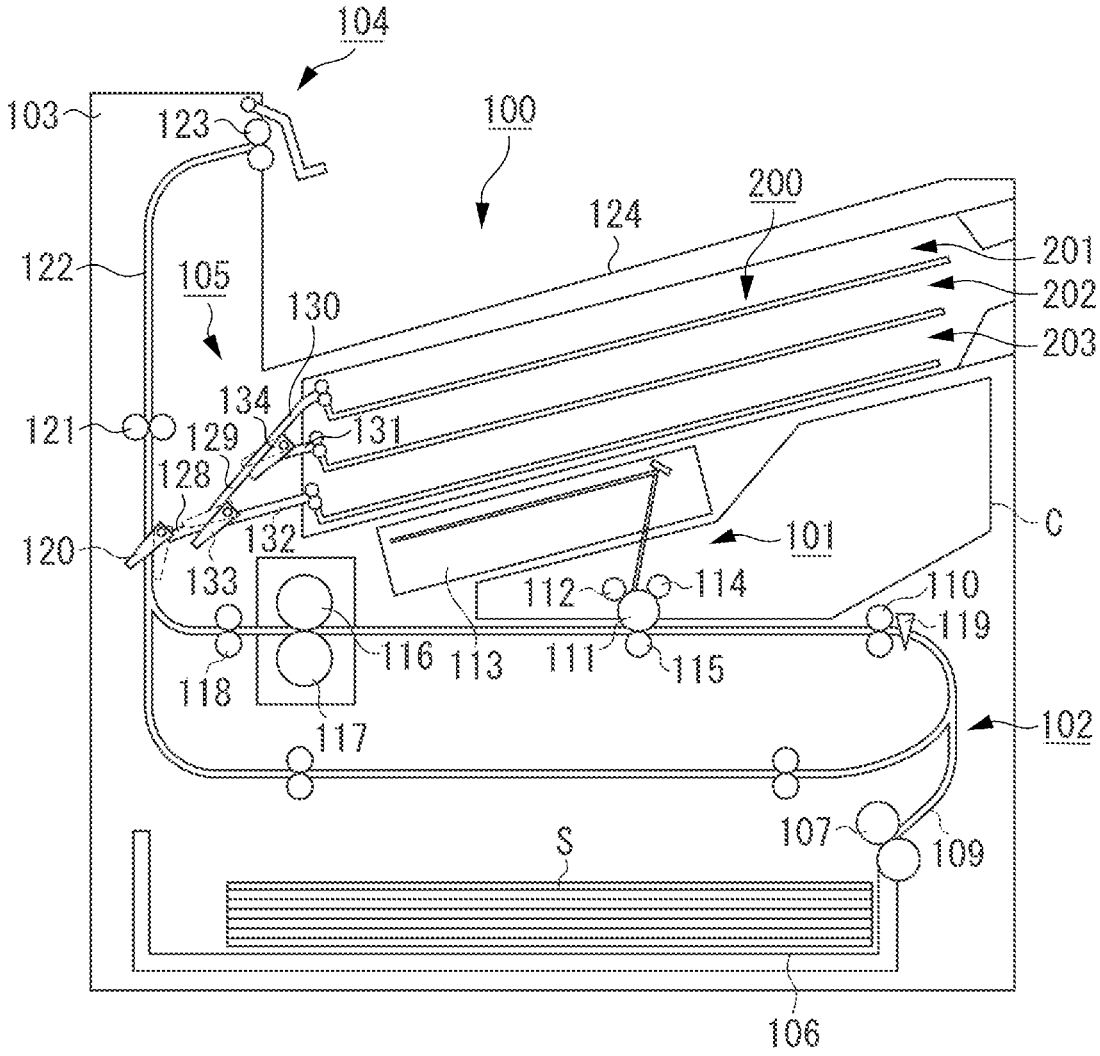
FIG. 1 illustrates a configuration of an image forming apparatus according to a first exemplary embodiment.

FIG. 1 illustrates a configuration of an image forming apparatus equipped with a storage portion according to a first exemplary embodiment. In the present exemplary embodiment, a laser beam printer is used as an example of the image forming apparatus.

The image forming apparatus 100 includes an image forming portion 101, a supply portion 102, which supplies a sheet S to the image forming portion 101, an apparatus body 103, and a discharge portion 104, which discharges the sheet S having an image formed thereon by the image forming portion 101. In the present exemplary embodiment, the sheet S is used to have an image formed thereon by the image forming apparatus 100, and includes, for example, paper, overhead projector (OHP) sheet, and cloth. Furthermore, the image forming apparatus 100 includes a sheet storage device 200 located above the image forming portion 101. The sheet storage device 200 includes a plurality of sheet storage portions 201 to 203 (intermediate trays), each of which temporarily stores the sheet S having an image formed thereon. Moreover, the image forming apparatus 100 includes a conveyance unit 105, which conveys the sheet S having an image formed thereon to the sheet storage device 200.

The image forming portion 101 includes a photosensitive drum 111, which rotates clockwise (in the CW direction) as viewed in FIG. 1, a charging roller 112, which charges the surface of the photosensitive drum 111, and an exposure device 113, which forms an electrostatic latent image by radiating light onto the photosensitive drum 111. The image forming portion 101 further includes a developing device 114, which forms a toner image on the photosensitive drum 111 by applying toner to the electrostatic latent image, and a transfer roller 115, which transfers the toner image to the conveyed sheet S. Furthermore, the image forming portion 101 includes a fixing roller 116, a pressure roller 117, which is in contact with the fixing roller 116, and a fixing discharge roller 118, to fix, to the sheet S, the toner image transferred to the sheet S. Thus, the image forming portion 101 forms a toner image on the sheet S by using such an electrophotographic image forming process.

In the image forming apparatus 100 according to the present exemplary embodiment, the photosensitive drum 111, the charging roller 112, the developing device 114, and a toner storage portion (not illustrated), which stores toner, are integrated as a cartridge C, which is detachably attached to the apparatus body 103. When toner runs out, the user can replace the cartridge C with a new cartridge C. This enables the user to perform maintenance on the image forming apparatus 100 without recourse to a service engineer. Furthermore, the present exemplary embodiment is not limited to such a cartridge-type image forming apparatus 100, but can also be applied to a configuration in which such members as the photosensitive drum 111, the charging roller 112, and the developing device 114 are fixedly mounted to the apparatus body 103 (a type that does not require the replacement of the members).

The supply portion 102 includes a supply cassette 106, in which a plurality of sheets S to be used for image formation is stored in a stacked state, a supply roller 107, a conveyance guide 109, and a registration roller 110. Furthermore, a sensor 119, which is mounted in the vicinity of the registration roller 110, detects the leading edge of a sheet being conveyed, to determine the timing at which to start image formation by the image forming portion 101. The sensor 119 is composed of a flag and a photo-interrupter (both not illustrated) and has a configuration in which as the flag is moved by a sheet being conveyed, the photo-interrupter outputs an ON or OFF signal.

The discharge portion 104 includes a first switching member 120, a conveyance roller 121, a discharge guide 122, a discharge roller 123, and a discharge tray 124 (a stacking portion). The first switching member 120 is configured to be switched by an actuator (not illustrated) between a position, indicated with a solid line in FIG. 1, to direct the image-formed sheet S to the sheet storage device 200 and a position, indicated with a broken line in FIG. 1, to direct the image-formed sheet S to the discharge tray 124. The discharge tray 124, which is mounted on the upper surface of the image forming apparatus 100, can be used in common by a plurality of users. Onto the discharge tray 124, the sheet S is discharged with the image-formed surface (the first surface) face-down.

The conveyance unit 105 includes a second switching member 133 and a third switching member 134, each of which switches the conveyance destination of the sheet S, and conveyance guides 128 to 132, which guide the sheet S to the respective sheet storage portions 201 to 203. In the present exemplary embodiment, each of the second switching member 133 and the third switching member 134 is configured to be switched by an actuator (not illustrated) between a position indicated with a solid line in FIG. 1 and a position indicated with a broken line in FIG. 1. For example, in the case of conveying the sheet S to the first sheet storage portion 201, the second switching member 133 and the third switching member 134 are switched to be located at the positions indicated with a solid line in FIG. 1. The sheet S passes from the conveyance guide 128 to the conveyance guides 129 and 130 in turn and is then conveyed to the sheet storage portion 201. Furthermore, in the case of conveying the sheet S to the second sheet storage portion 202, only the third switching member 134 is switched to be located at the position indicated with a broken line in FIG. 1. In this case, the sheet S passes through the conveyance guides 128, 129, and 131 in this order and is then conveyed to the sheet storage portion 202. Onto the sheet storage portions 201 to 203, like the discharge tray 124, the sheet S is discharged with the image-formed surface face-down.

(Configuration of Sheet Storage Device)

Figure 2:
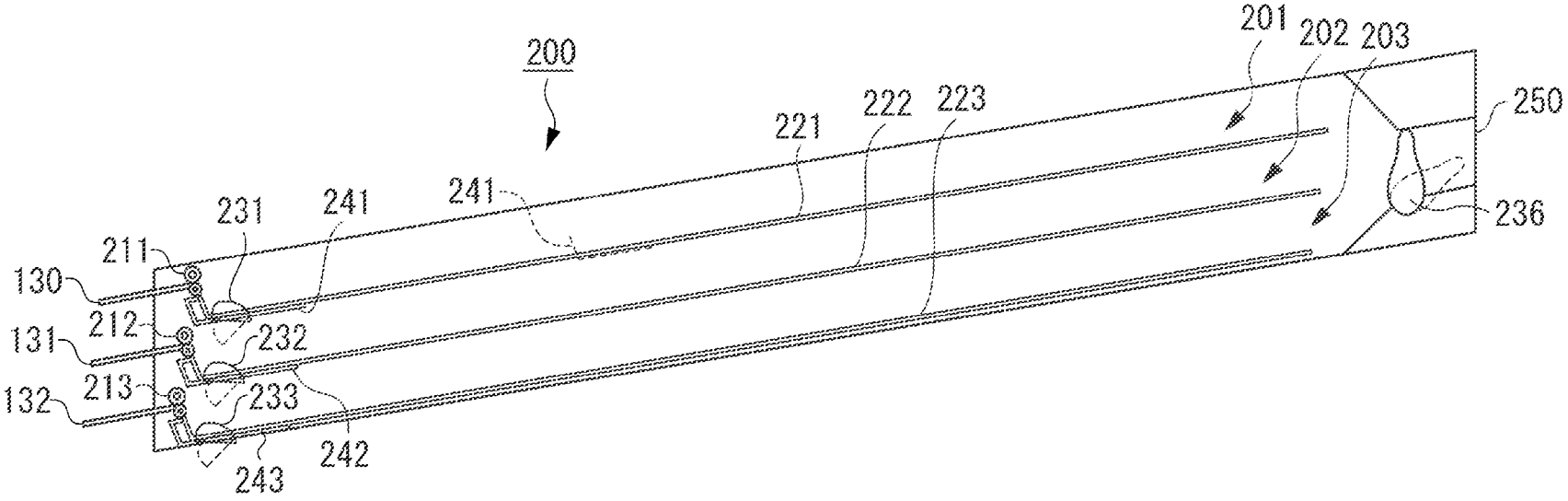
FIG. 2 illustrates a configuration of a sheet storage device according to the first exemplary embodiment.

FIG. 2 illustrates a configuration of the sheet storage device 200. In the sheet storage device 200 according to the present exemplary embodiment, the sheet storage portions 201 to 203 (intermediate trays), which are arranged as a plurality of layers, are located to be piled in the vertical direction. Since the sheet storage portions 201 to 203 have the same configuration, only the configuration of the sheet storage portion 201 is described herein.

The sheet storage portion 201 includes a conveyance roller 211, which conveys the sheet S, a stacking tray 221, which temporarily stores the sheet S in a stacked state inside the apparatus body 103, and a sheet presence/absence sensor 231, which detects whether the sheet S is stored in the stacking tray 221. The sheet storage portion 201 further includes a sheet movement unit 241, which pushes the trailing edge of the sheet S stored in the sheet storage portion 201 (the edge portion on the upstream side in the conveyance direction of the sheet S) to expose a part of the sheet S stored in the sheet storage portion 201 to outside the apparatus body 103. The sheet movement unit 241 moves the sheet S up to the position at which the sheet S becomes receivable by the user, i.e., until the leading edge of the sheet S (the edge portion on the downstream side in the conveyance direction of the sheet S) passes through an opening 250. This enables exposing the sheet S to outside the apparatus body 103 by a predetermined length. The predetermined length by which to expose the sheet S to outside the apparatus body 103 is set to 30 mm in the present exemplary embodiment. This predetermined length is merely an example, and may be set to a length that enables the user to pinch the exposed sheet S and that prevents the sheet S from greatly warping.

Furthermore, the stacking tray 221 is set to a length that prevents the leading edge of the sheet S from being exposed from the opening 250 even in a case where the sheet S stacked in the sheet storage portion 201 has a maximum size that allows the sheet S to be stored in the sheet storage portion 201. When the sheet S is stacked on the stacking tray 221 and the sheet presence/absence sensor 231 is pushed down by the stacked sheet S to the position indicated with a broken line, the sheet presence/absence sensor 231 comes into an ON state. When the sheet S is moved by the sheet movement unit 241 and the sheet presence/absence sensor 231 is returned to the position indicated with a solid line, the sheet presence/absence sensor 231 comes into an OFF state. Furthermore, when the leading edge of the moved sheet S pushes down an opening sensor 236, which is located in the vicinity of the opening 250, to the position indicated with a broken line, the opening sensor 236 comes into an ON state. When the sheet S, which has been exposed to outside the apparatus body 103, is removed and the opening sensor 236 is returned to the position indicated with a solid line, the opening sensor 236 comes into an OFF state. The sheet movement unit 241 is located in a stacking position indicated with a solid line when the sheets S are sequentially conveyed to the sheet storage portion 201. On the other hand, when exposing the stored sheet S, the sheet movement unit 241 moves toward the opening 250 along the conveyance direction of the sheet S and reaches an exposing position indicated with a broken line. The location of the exposing position, i.e., the distance by which the sheet movement unit 241 moves, is determined according to the length by which to expose the sheet S and the size in the conveyance direction of the sheet S.

Furthermore, the sheet storage device 200 is surrounded by a member except a conveyance entrance (not illustrated), via which to convey the sheet S to inside the sheet storage device 200, and the opening 250, via which to expose the stored sheet S to outside the sheet storage device 200. The member surrounding the sheet storage device 200 is made from an opaque material. Accordingly, in a condition in which the sheet S is stored in any one of the sheet storage portions 201 to 302, information printed on the stored sheet S is not viewable by the user.

Figure 3:
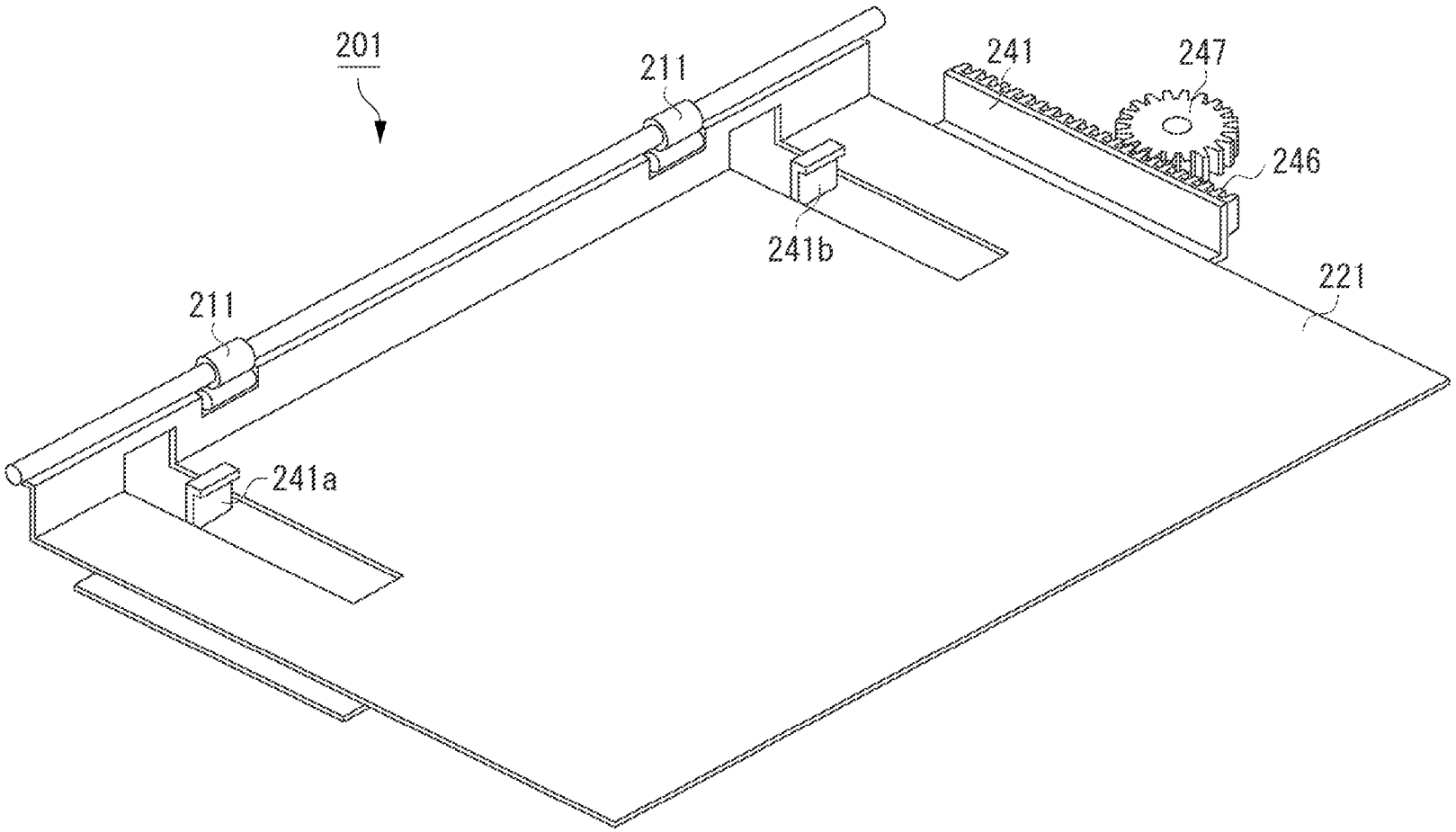
FIG. 3 is a perspective view of a sheet storage portion according to the first exemplary embodiment.

FIG. 3 is a perspective view of the sheet storage portion 201. Referring to FIG. 3, the sheet movement unit 241 is located between the stacking position and the exposing position. The sheet movement unit 241 includes two sheet trailing edge push portions 241*a* and 241*b*, which are arranged along the width direction of the sheet S. Furthermore, the sheet movement unit 241 integrally includes a rack 246. The rack 246 meshes with a pinion 247. The pinion 247 is coupled to an actuator serving as a drive unit (not illustrated). Driving the actuator in the normal direction or the opposite direction enables the sheet movement unit 241 to move backward or forward between the stacking position and the exposing position.

(Control Portions and Functional Configuration)

Figure 4:
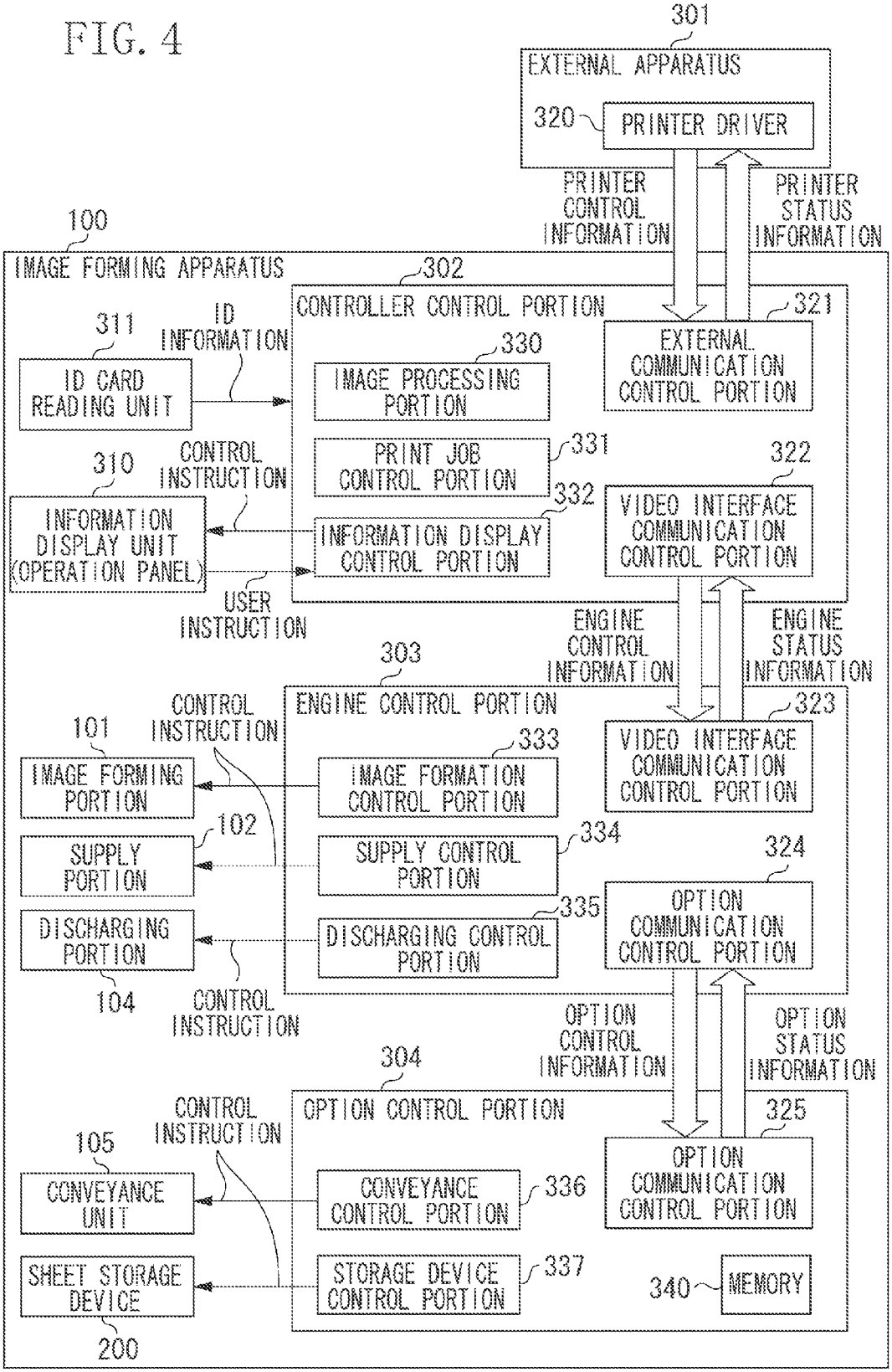
FIG. 4 is a block diagram illustrating a functional configuration, serving as control portions, of the image forming apparatus according to the first exemplary embodiment.

FIG. 4 is a block diagram illustrating a functional configuration of the image forming apparatus 100 according to the present exemplary embodiment. The image forming apparatus 100 includes, as control portions, a controller control portion 302, an engine control portion 303, and an option control portion 304. An external apparatus 301 and the controller control portion 302, the controller control portion 302 and the engine control portion 303, and the engine control portion 303 and the option control portion 304 are interconnected via respective communication units (not illustrated) and are configured to exchange information about their control operations and statuses via communication control portions 320 to 325. The external apparatus 301 includes a printer driver 320, which transmits printer control information to the controller control portion 302 or receives printer status information from the controller control portion 302.

The controller control portion 302 receives the printer control information from the external apparatus 301, such as a personal computer (PC), connected to the image forming apparatus 100 via a network, such as a local area network (LAN), and performs print control. Then, the controller control portion 302 transmits control information to the engine control portion 303, and further to the option control portion 304, to execute printing. The controller control portion 302 includes an image processing portion 330, which performs image processing based on information on an image included in the printer control information, and a print job control portion 331, which determines an operation of the engine control portion 303 by processing printer job information included in the printer control information. The controller control portion 302 further includes an information display control portion 332, which controls an information display unit 310, such as an operation panel, mounted on the image forming apparatus 100. The information display unit 310 displays information to the user and receives an instruction from the user. An ID card reading unit 311, which is also mounted on the image forming apparatus 100, is used to perform user authentication. ID information of the card read by the ID card reading unit 311 is transmitted to the controller control portion 302. Furthermore, the controller control portion 302 includes a video interface communication control portion 322, which transmits engine control information to the engine control portion 303 or receives engine status information from the engine control portion 303.

The engine control portion 303 includes an image formation control portion 333, which controls the image forming portion 101, a supply control portion 334, which controls the supply portion 102, and a discharge control portion 335, which controls the discharge portion 104. The engine control portion 303 causes the image forming portion 101, the supply portion 102, and the discharge portion 104 to operate based on engine control information acquired via a video interface communication control portion 323. Furthermore, the engine control portion 303 includes an option communication control portion 324, which transmits option control information to the option control portion 304 or receives option status information from the option control portion 304.

The option control portion 304 includes a conveyance control portion 336, which controls the conveyance unit 105, and a storage device control portion 337, which controls the sheet storage device 200. Furthermore, the option control portion 304 includes a memory 340 (for example, a random access memory (RAM) serving as a memory portion, which stores information about sheets stored in the sheet storage device 200. The option control portion 304 causes the conveyance unit 105 and the sheet storage device 200 to operate based on option control information acquired via the option communication control portion 325. The option control portion 304 controls the conveyance unit 105 to store the image-formed sheets into the respective sheet storage portions 201 to 203. Furthermore, the option control portion 304 controls the sheet storage device 200 to expose sheets stored in the respective sheet storage portions 201 to 203 from the opening 250.

(Selection of Method for Using Sheet Storage Device)

With the above-described configuration, a control operation performed when a sheet or sheets are stored into the sheet storage device 200 as a result of an instruction for image formation issued by the user is described below.

Figure 5:
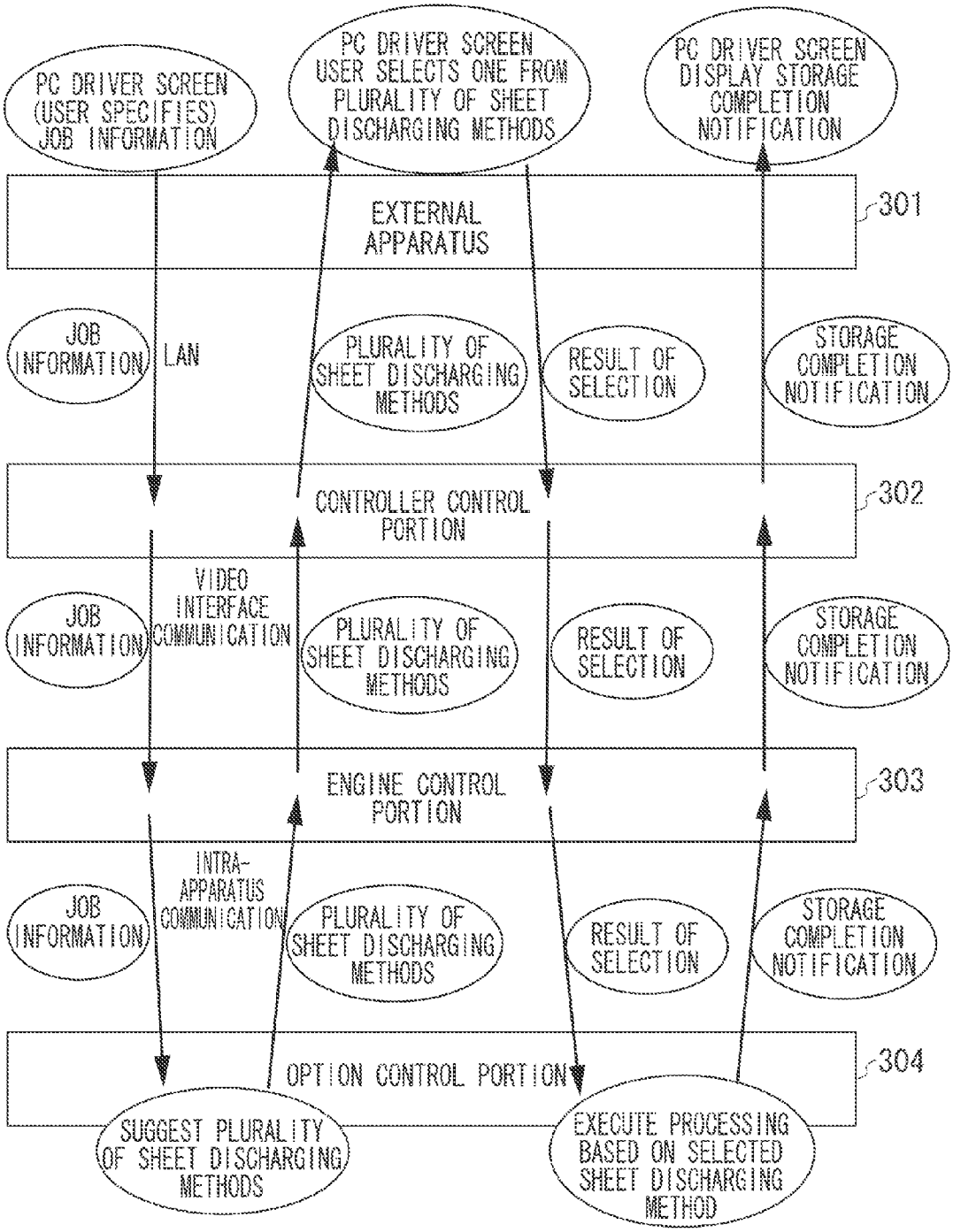
FIG. 5 illustrates flows of data used to determine a sheet discharging method according to the first exemplary embodiment.

FIG. 5 illustrates flows of data used to determine a method for discharging sheets with respect to a job to be performed for printing. When the user issues an instruction for image formation and, then, job information is transmitted from the external apparatus 301 to the controller control portion 302, the job information is then transmitted to the option control portion 304 via the engine control portion 303. The option control portion 304 suggests a plurality of sheet discharging methods executable based on information about the storing state of each sheet storage portion stored in the memory 340 and the job information. The information about the storing state of each sheet storage portion includes, for example, information for determining the presence or absence of failure of each sheet storage portion and information indicating the sheet stacking state. A sheet storage portion determined to be in a state of failure based on the information for determining the presence or absence of failure of each sheet storage portion is then prevented from storing sheets. The information indicating the sheet stacking state is, for example, information indicating whether any sheet is stored in each sheet storage portion, and can be acquired based on results of detection by the sensors 231 to 233. Furthermore, the information about the storing state of each sheet storage portion includes information indicating the number of sheets stored in each sheet storage portion and information about a user who has issued an image forming instruction for image formation on a sheet stored in each sheet storage portion. Moreover, the job information includes information indicating the number of sheets which are objects of the image forming instruction, information about a user who has issued the image forming instruction, information indicating a job number corresponding to sheets which are objects of the image forming instruction, and information about the number of copies included in sheets which are objects of the image forming instruction.

Information on the plurality of sheet discharging methods is transmitted to the external apparatus 301 via the engine control portion 303 and the controller control portion 302, and, then, the plurality of sheet discharging methods is displayed on a screen of the external apparatus 301, thus prompting the user to make a selection. When the user selects one of the plurality of sheet discharging methods, a result of the selection is transmitted to the option control portion 304 via the controller control portion 302 and the engine control portion 303, and, at the same time, printing for the job is started. During execution of the printing, the option control portion 304 distributes sheets into the associated sheet storage portions according to the selected sheet discharging method. When all of the sheets have been stored, the option control portion 304 transmits a storage completion notification to the external apparatus 301, thus notifying the user that the sheets have become ready to be discharged.

An example of an operation performed from the time of reception of a print job to the time of discharging of sheets is more specifically described below. The sheet storage device 200 as used herein includes three sheet storage portions 201 to 203 as illustrated in FIG. 2. Each sheet storage portion is capable of stacking up to ten sheets thereon. The job information includes the number of sheets to be used for printing, information on a user who has issued an instruction for printing, information on a group into which the user is classified, and the number of copies with which sheets are to be used for printing.

Figure 6:
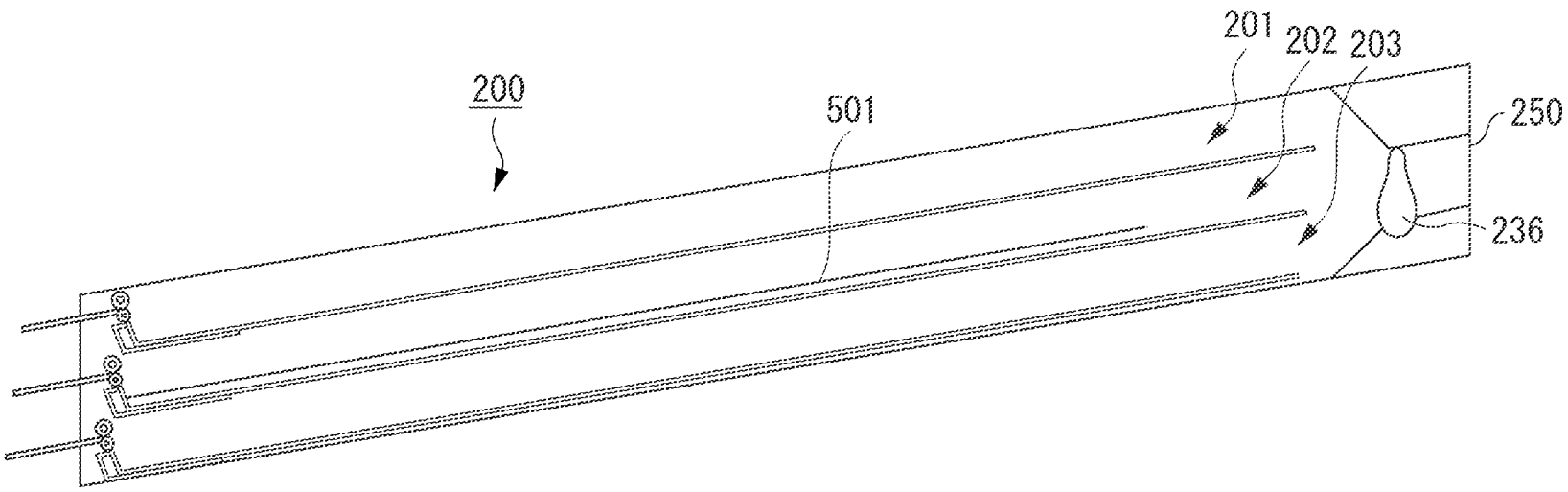
FIG. 6 illustrates an initial state of the sheet storage device according to the first exemplary embodiment.

When a print job is received, as illustrated in FIG. 6, a sheet 501, on which printing has been performed in response to an instruction for image formation issued by a user A (group 1), is currently stored in the sheet storage portion 202. An operation performed when a job for a user B (group 1) is received in the condition illustrated in FIG. 6 is described below. In the present exemplary embodiment, the job for the user B (group 1) is a print request with four sheets by three copies (twelve sheets in total). In this instance, since the number of sheets to be used for printing with the job for the user B exceeds the upper limit number of sheets (ten sheets) allowed to be stored in a single sheet storage portion, it is necessary to store the sheets in a plurality of sheet storage portions. Various methods for storing the sheets can be considered, and an optimum storing method may be varied depending on users.

The option control portion 304 suggests three methods based on the following three different ideas. However, the operation performed according to the present exemplary embodiment is not limited to these ideas.

Figure 7A:
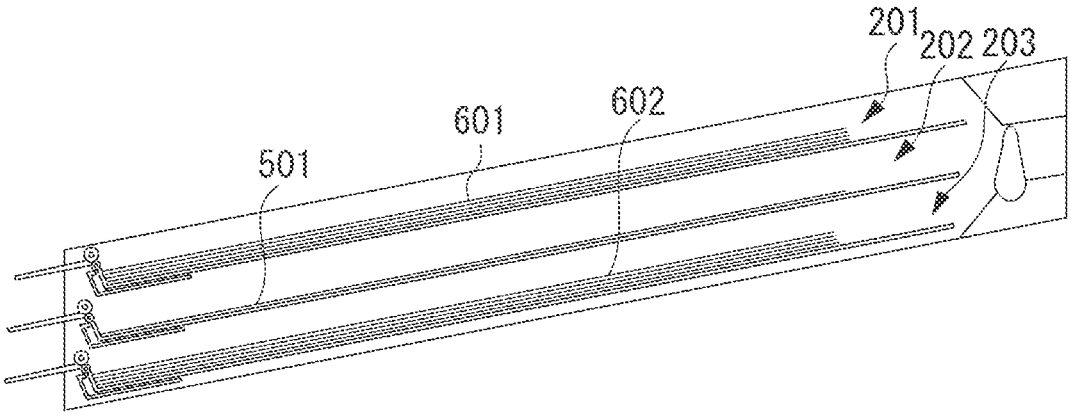
FIGS. 7A and 7B illustrate operations in a case where a first method is selected as a specific example according to the first exemplary embodiment.
Figure 7B:
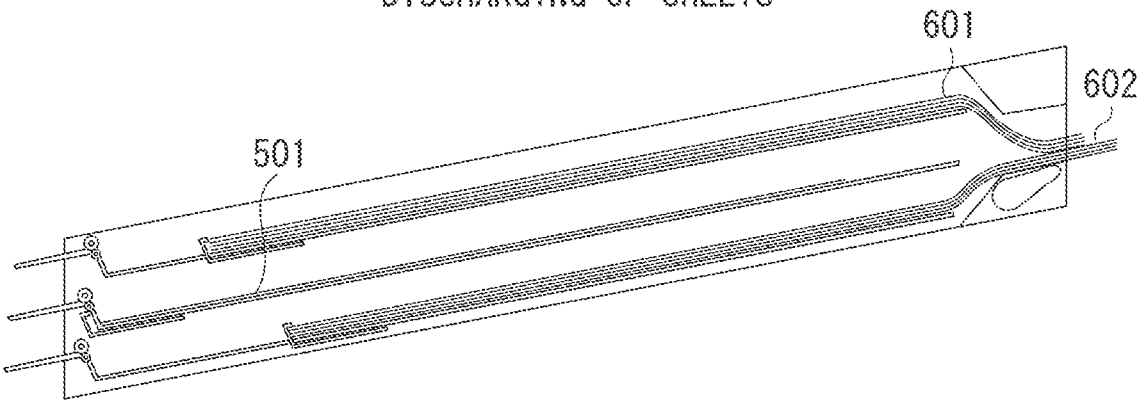

The first method includes using only vacant sheet storage portions, in which no sheets are stored, and exposing the sheets for the associated user to outside the apparatus body 103 via the opening 250 with a single discharging operation. First, the image forming apparatus 100 stores image-formed sheets into the sheet storage portions 201 and 203, as illustrated in FIG. 7A. Then, in response to an instruction for discharging sheets issued by the user B, the image forming apparatus 100 exposes sheet stacks 601 and 602 together in combination to outside the apparatus body 103 via the opening 250, as illustrated in FIG. 7B. In this instance, the sheet stacks 601 and 602 differ from each other in the length of a part exposed to outside the apparatus body 103 via the opening 250 due to the different movements of the sheet movement units 241 and 243. Therefore, the user can distinguish between the two sheet stacks. The state in which a part of the sheet is kept inside the apparatus body 103 and the sheet is stopped with the other part of the sheet exposed to outside the apparatus body 103 is defined as an exposed state. Furthermore, in FIGS. 7A and 7B, the sheet stack 601 is a sheet stack with four sheets by one copy (four sheets in total), and the sheet stack 602 is a sheet stack with four sheets by two copies (eight sheets in total). Therefore, the user needs to sort the sheet stack 602 by each copy. Furthermore, in the first method, the user can issue a sheet discharging instruction by inputting a password, previously set by the user, to the external apparatus 301 or the information display unit 310. Alternatively, the user can issue a sheet discharging instruction by swiping the user's own ID card through the ID card reading unit 311 to perform user authentication.

Figure 8A:
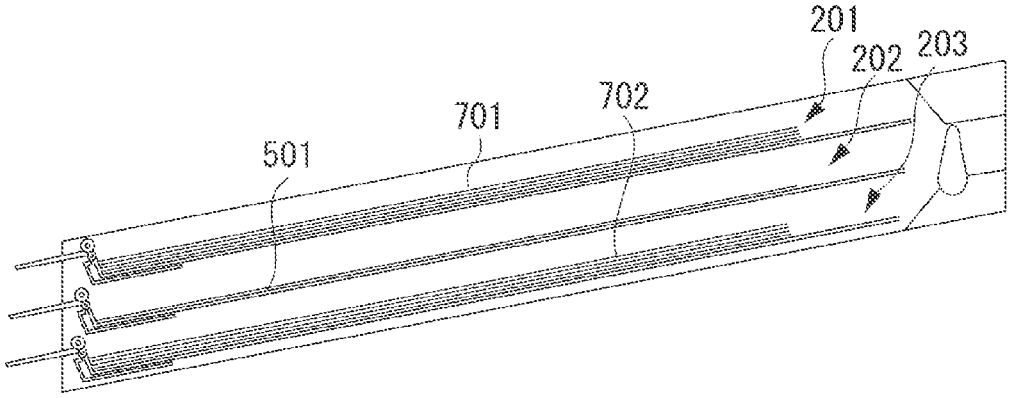
FIGS. 8A and 8B illustrate operations in a case where a second method is selected as a specific example according to the first exemplary embodiment.
Figure 8B:
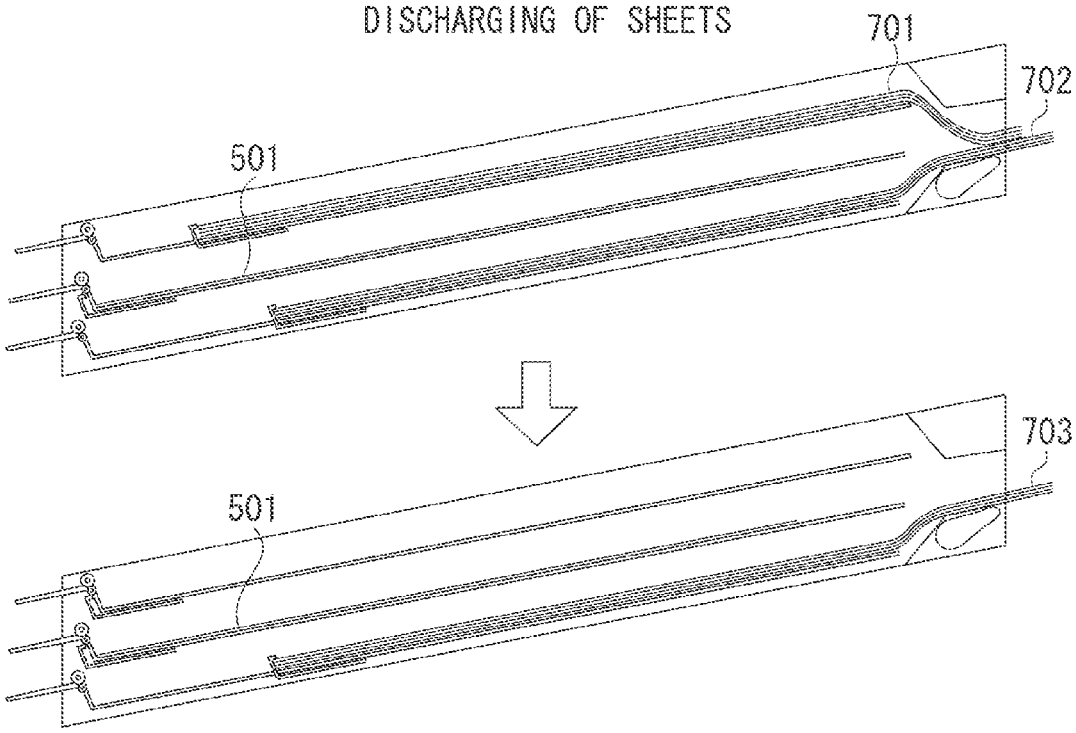

The second method includes using only vacant sheet storage portions, in which no sheets are stored, and performing a plurality of sheet discharging operations without requiring the user to sort the sheets by each copy. First, as illustrated in FIG. 8A, the image forming apparatus 100 stores two copies, from among four sheets by three copies, one copy into the sheet storage portion 201 and one copy into the sheet storage portion 203. Then, in response to an instruction for discharging sheets issued by the user B, the image forming apparatus 100 exposes sheet stacks 701 and 702 together in combination to outside the apparatus body 103 via the opening 250, as illustrated in FIG. 8B. In this instance, the sheet stacks 701 and 702 differ from each other in the length of a part exposed to outside the apparatus body 103 via the opening 250 due to the different movements of the sheet movement units 241 and 243. Therefore, the user can distinguish between the two sheet stacks. When the sensor 236 detects that the user has taken out the sheet stacks 701 and 702, the image forming apparatus 100 conveys a sheet stack 703, which is one remaining copy, to the vacant sheet storage portion 203 and, then, exposes the sheet stack 703 to outside the apparatus body 103 via the opening 250, as illustrated in FIG. 8B. Accordingly, in the second method, although the user can take out the sheets by each copy, the time length required to take out all of the sheets from the sheet storage device 200 is longer than in the first method. Furthermore, in the second method, the user can issue a sheet discharging instruction by inputting a password, previously set by the user, to the external apparatus 301 or the information display unit 310. Alternatively, the user can issue a sheet discharging instruction by swiping the user's own ID card through the ID card reading unit 311 to perform user authentication.

The third method includes also exposing the sheets for the user A, which is previously stored in the sheet storage portion 202, together in combination with the sheets for the user B to outside the apparatus body 103 via the opening 250. This method can secure vacant sheet storage portions. The image forming apparatus 100 determines whether the image forming apparatus 100 is allowed to expose the sheets for the user A and the sheets for the user B together in combination, based on groups in the user classification included in the job information. The image forming apparatus 100 selects, as a candidate for simultaneous discharging, sheets for a user having the same group information as the group information of a user of a new received print job. Since the user A and the user B belong to the same group 1, the option control portion 304 suggests the third method. If the user B belongs to a group different from that of the user A (for example, group 2), the option control portion 304 does not suggest the third method.

Figure 9A:
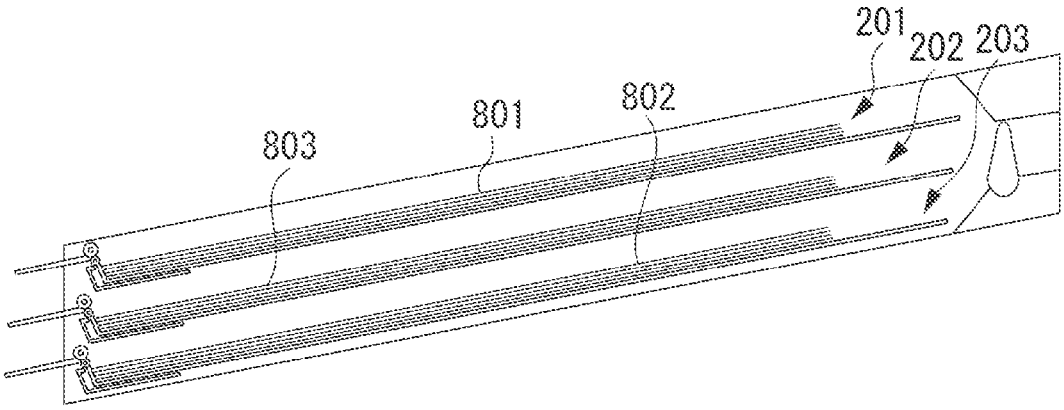
FIGS. 9A and 9B illustrate operations in a case where a third method is selected as a specific example according to the first exemplary embodiment.
Figure 9B:
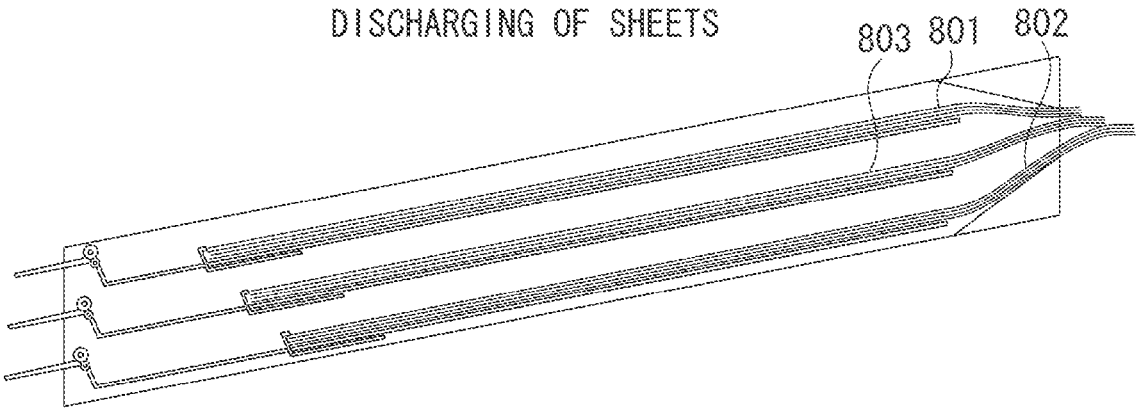

FIG. 9A illustrates a condition in which sheets are distributed according to the third method. One copy of sheets for the user B is distributed to each of the sheet storage portions 201 to 203. Accordingly, each of sheet stacks 801 and 802 is a sheet stack obtained by stacking four sheets for the user B, and a sheet stack 803 is a sheet stack obtained by stacking four sheets for the user B on one sheet for the user A. Thus, the sheet stack 803 is a mixture of the sheet for the user A and the sheets for the user B. In response to an instruction for sheet discharging, the image forming apparatus 100 simultaneously exposes the sheet stacks 801 to 803 from the sheet storage portions 201 to 203, as illustrated in FIG. 9B. In this instance, the sheet stacks 801 to 803 differ from one another in the length of a part exposed to outside the apparatus body 103 via the opening 250 due to the different movements of the sheet movement units 241 to 243. Therefore, the user can distinguish between the three sheet stacks. However, since, among the three sheet stacks, the sheet stack 803 is a mixture of the sheet for the user A and the sheets for the user B, the user is required to sort them. Furthermore, in the third method, the user can issue a sheet discharging instruction by inputting a password, previously set by the user, to the external apparatus 301 or the information display unit 310. Alternatively, the user can issue a sheet discharging instruction by swiping the user's own ID card through the ID card reading unit 311 to perform user authentication.

To suggest the above-mentioned three methods to the user, the option control portion 304 transmits information to the printer driver 320 via the engine control portion 303 and the controller control portion 302. The printer driver 320 displays the received three methods on the screen of the external apparatus 301 to prompt the user to make a selection.

FIG. 10 illustrates the content of the information that the option control portion 304 transmits to the printer driver 320. Since the printer driver 320 only needs to express the state of a sheet stack that has been exposed, the information to be transmitted does not include location information about sheet storage portions in which to store sheets.

In FIG. 10, the term "ordinal number" indicates the position in a sequential order at which to expose sheets via the opening 250 in response to a user's instruction for sheet discharging. Here, sheet stacks with the same ordinal number are exposed at the same timing together in combination via the opening 250. Moreover, with regard to sheet stacks with the respective different ordinal numbers, after a sheet stack with the former ordinal number is taken out from the opening 250, a sheet stack with the latter ordinal number is moved by the associated sheet movement unit to be exposed to outside the apparatus body 103 via the opening 250. The option control portion 304 determines whether the sheet stack with the former ordinal number has been taken out from the opening 250, based on a result of detection by the opening sensor 236.

Furthermore, in FIG. 10, the term "sheet stack No." indicates a number assigned to a sheet stack in the order of the uppermost sheet stack to the lower sheet stack, as exposed via the opening 250, so as to distinguish sheet stacks to be exposed. Moreover, in FIG. 10, the term "exposure length" indicates the length by which a sheet stack is exposed to outside the apparatus body 103 via the opening 250. The exposure length is classified into "large", "medium", and "small", because it only needs to enable distinguishing sheet stacks that have been simultaneously exposed. However, the exposure length may be expressed as an actual value of the exposure length or as a number assigned in the order of descending exposure lengths or ascending exposure lengths.

Furthermore, in FIG. 10, the term "sheet configuration" indicates information about the respective sheet stacks. In the example illustrated in FIG. 10, user information on a user that has issued a printing instruction for sheets and information on the ordinal number of a copy are described in the column "sheet configuration". In the present exemplary embodiment, since the job of the user A is composed of only one sheet, the number of copies for the user A is one, which is expressed as "the first copy" in FIG. 10. Since the job of the user B is composed of four sheets by three copies, the respective copies with four sheets are expressed as "the first copy, "the second copy", and "the third copy" in a discriminable manner. In addition, the information to be displayed may include the number of sheets of each sheet stack.

Figure 11:
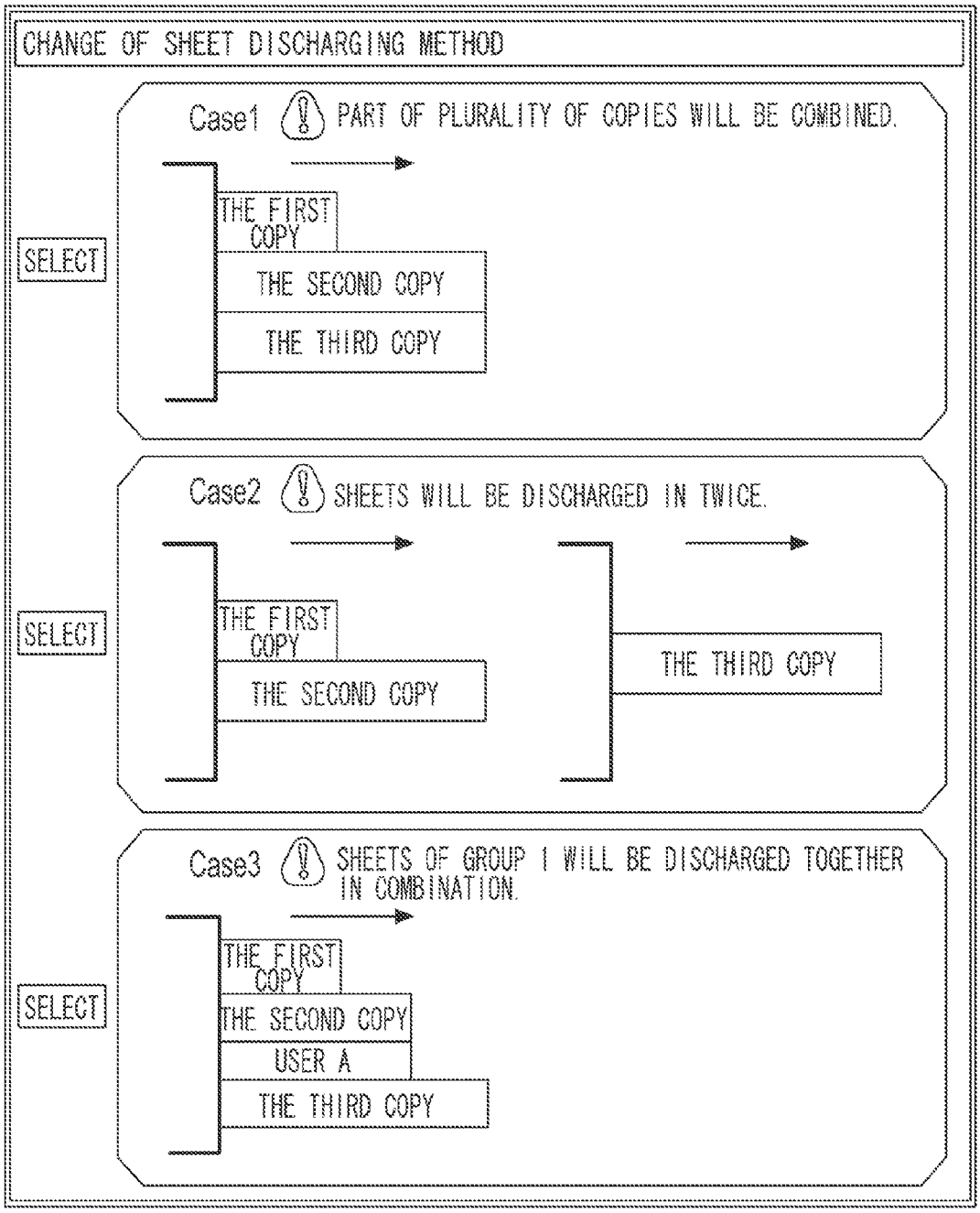
FIG. 11 illustrates an example of a screen used to allow a user B to select a sheet discharging method according to the first exemplary embodiment.

FIG. 11 illustrates an example of a display indicating sheet discharging methods on the screen of the external apparatus 301. The display schematically shows the manner in which sheet stacks are exposed via the opening 250 with respect to each of the three methods, thus prompting the user to make a selection. The user can check the displayed information, visually suppose the state in which sheet stacks have been exposed, and select a desired sheet discharging method via a "SELECT" button located on the left of each suggestion.

When the user selects one method from among a plurality of methods, the printer driver 320 transmits a result of the selection to the option control portion 304 via the controller control portion 302 and the engine control portion 303. In response to the reception of the selection result, the image forming apparatus 100 starts printing for the associated job, and the option control portion 304 stores sheets into the respective sheet storage portions in such a manner as to enable the selected method. When all of the sheets have been completely stored, the option control portion 304 transmits, to the printer driver 320 via the engine control portion 303 and the controller control portion 302, a storage completion notification indicating that the sheets have become ready to be discharged via the opening 250. Since all of the sheets that are allowed to be stored into the respective sheet storage portions have been stored into the sheet storage portions, the printer driver 320 displays, on the screen of the external apparatus 301 to the user, information indicating that the sheets have become ready to be discharged, thus prompting the user to come to take out the sheets. The user can go in front of the image forming apparatus 100 and issue a sheet discharging instruction according to the above-mentioned method via the information display unit 310 or the ID card reading unit 311 illustrated in FIG. 4. In response to the sheet discharging instruction, the option control portion 304 discharges the sheets according to the method selected by the user. Simultaneously with the sheet discharging operation, the selected method is displayed on the operation panel (the information display unit 310).

With the above-described operation, when the user takes out the exposed sheets via the opening 250, since the states of the sheet stacks can be set according to the user's instruction, the user can take out the sheets without being confused. Furthermore, since, even when a sheet discharging operation is required to be performed a plurality of times, the user is aware of the number of times in advance, the user can be prevented from forgetting to take out the sheets.

Thus, according to the present exemplary embodiment, the method of notifying the user of executable sheet discharging methods and allowing the user to select a desired sheet discharging method from among the executable sheet discharging methods enables providing an image forming apparatus with improved usability.

Furthermore, in the first exemplary embodiment, while a variety of sheet discharging methods may be conceived, three methods are suggested from the viewpoint of usability. More specifically, the three methods include a method of minimizing the number of times of a sheet discharging operation (the number of times the user takes out sheets via the opening 250), a method of preventing sheet stacks for the target user from losing any partition, such as distinction between copies, and a method of making sheet storage portions as vacant as possible. However, the suggestion of sheet discharging methods is not construed to be limited to the one created based on only the above-mentioned ideas.

Figure 12:
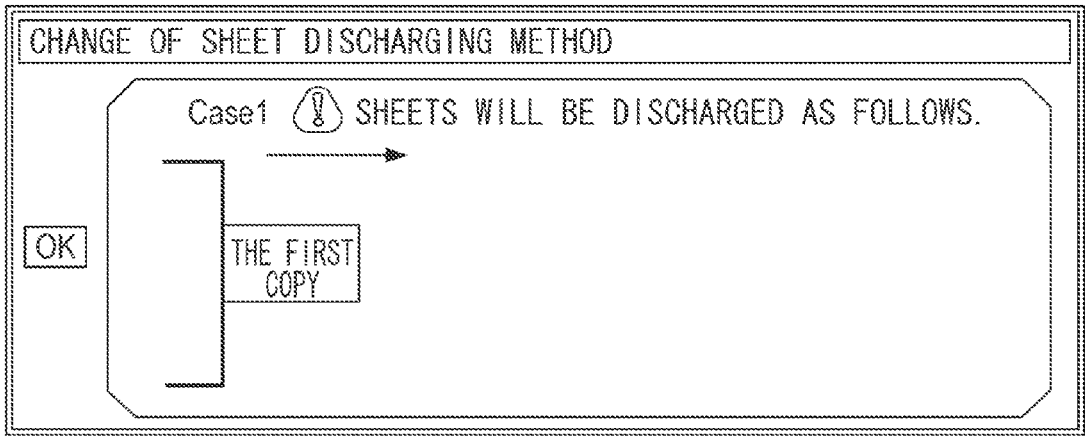
FIG. 12 illustrates an example of a screen used to allow a user A to select a sheet discharging method according to the first exemplary embodiment.

Furthermore, in the first exemplary embodiment, when the user B has selected the third method, the sheet stacking condition of the sheet storage device 200 results in a state illustrated in FIG. 9A. When the user A has transmitted a print job and has performed printing, only the sheets for the user A are stored in the sheet storage device 200. Thus, as illustrated in FIG. 12, the user A is informed that only the sheets for the user A will be exposed. If, before the user A takes out the sheets for the user A, the above-mentioned third method is selected by the user B and the sheets for the user B are stored into the sheet storage device 200, the sheets for the user A would become unable to be discharged in the sheet discharging method of which the user A was informed. Therefore, if the third method is selected by the user B, the image forming apparatus 100 may be configured to inform the user A anew that the sheet discharging method has been changed.

More specifically, when the option control portion 304 has received a result of selection of the sheet discharging method, the option control portion 304 determines whether the changed sheet discharging method affects another user. When determining that the changed sheet discharging method affects another user, the option control portion 304 transmits, to that user, information indicating the sheet discharging method changed as a result of selection. Furthermore, when the sheet discharging operation has been performed by a user, the option control portion 304 informs another concerned user that the sheets have been taken out.

Figure 13:
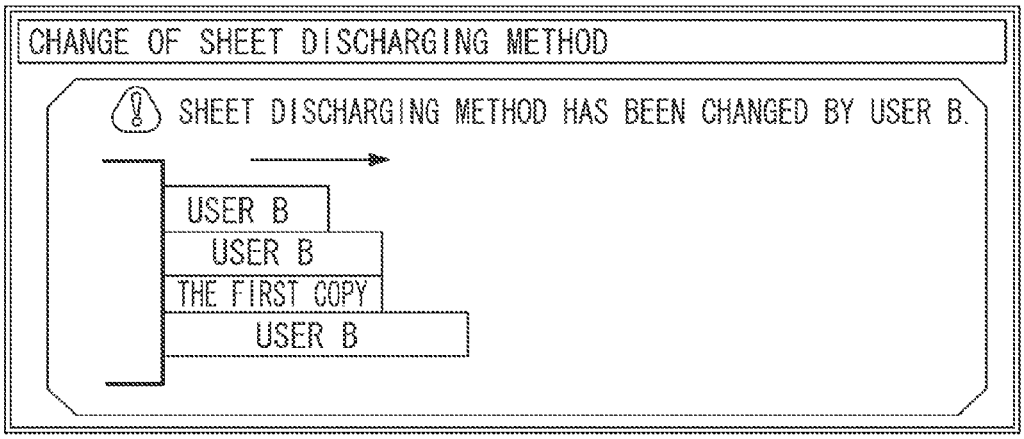
FIG. 13 illustrates an example of a screen used to allow the user A to select a sheet discharging method according to the first exemplary embodiment.

In the first exemplary embodiment, the following operations are performed when the user B has selected the third method. In a case where the user B has selected an operation of further stacking sheets for the user B on the sheet storage portion 202, on which sheets for the user A have already been stacked, the sheet discharging method selected by the user B is displayed on the screen of the external apparatus 301 of the user A as illustrated in FIG. 13. Then, in a case where the user B has taken out the sheets, the option control portion 304 informs the PC (the external apparatus 301) of the user A that the sheets have been taken out by the user B. Furthermore, in a case where the user A has issued an instruction to discharge the sheets, since the sheets have already been taken out, the option control portion 304 displays, on the information display unit 310 such as an operation panel, information indicating that the sheets have already been taken out by the user B.

In a case where the user A has taken out the sheets before the user B takes out the sheets, the option control portion 304 discharges the sheets while displaying, for the user A, the sheet discharging method selected by the user B on the operation panel in a way similar to that illustrated in FIG. 13. Furthermore, the option control portion 304 informs the user B via the screen of the external apparatus 301 that the sheets have been taken out by the user A. Moreover, even in a case where the user B has issued an instruction to discharge the sheets, the option control portion 304 displays, on the operation panel, information indicating that the sheets have been taken out by the user A.

As described above, a selected sheet discharging method may affect another user. Therefore, informing also another user who is affected of the selected sheet discharging method enables a user who takes out the sheets to correctly recognize the status of sheets to be discharged.

In the first exemplary embodiment, a configuration has been described in which the option control portion 304 is connected to the engine control portion 303 via a communication unit (not illustrated), and the option control portion 304 performs various control operations based on information acquired from the controller control portion 302 via the engine control portion 303. However, according to a second exemplary embodiment, the controller control portion 302 and the option control portion 304 may be configured to directly exchange information with each other.

Figure 14:
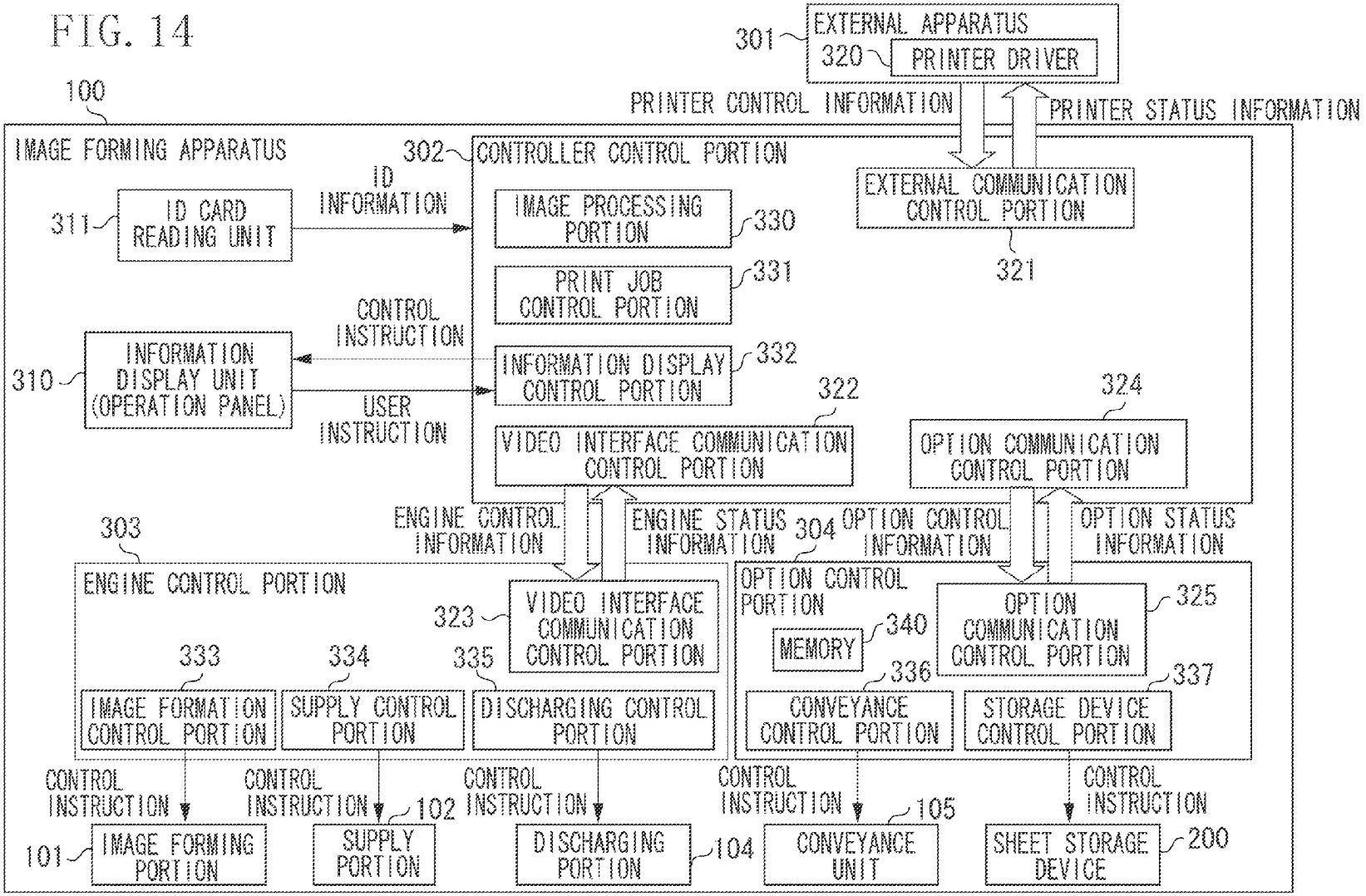
FIG. 14 is a block diagram illustrating a functional configuration, serving as control portions, of an image forming apparatus according to a second exemplary embodiment.

FIG. 14 is a block diagram illustrating a configuration in which the controller control portion 302 and the option control portion 304 directly exchange information with each other. The external apparatus 301 and the controller control portion 302, the controller control portion 302 and the engine control portion 303, and the controller control portion 302 and the option control portion 304 are interconnected via the respective communication units (not illustrated), and exchange information about the control operations and statuses of the apparatuses via the printer driver 320, the external communication control portion 321, the video interface communication control portion 322, the video interface communication control portion 323, the option communication control portion 324, and the option communication control portion 325. The configurations of the controller control portion 302, the engine control portion 303, and the option control portion 304 are similar to those in the first exemplary embodiment, and, therefore, the detailed description thereof is not repeated.

Figure 15:
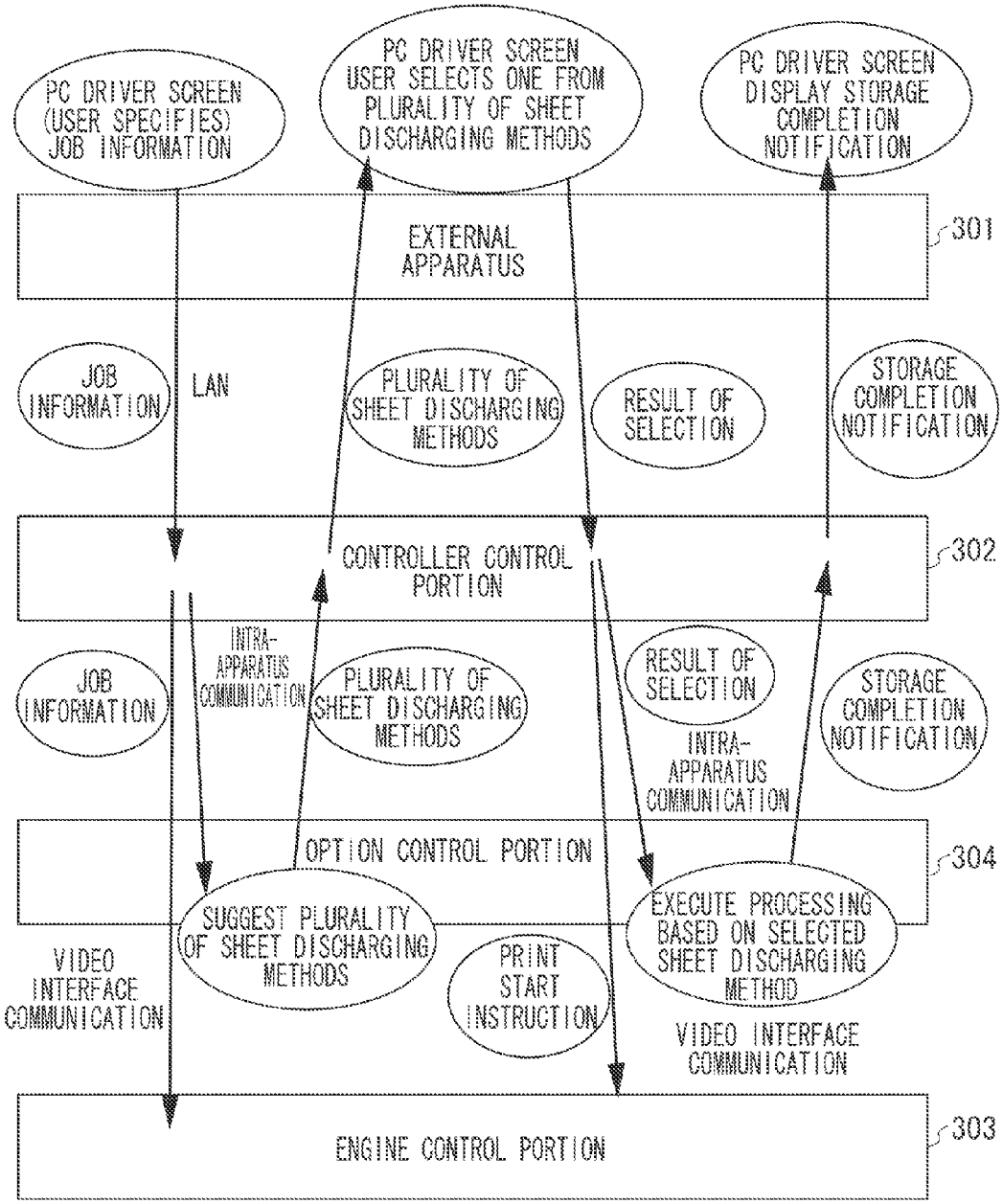
FIG. 15 illustrates flows of data used to determine a sheet discharging method according to the second exemplary embodiment.

FIG. 15 illustrates flows of data used to determine a method for discharging sheets with respect to a job to be performed for printing. When the user issues an instruction for image formation and, then, job information is transmitted from the external apparatus 301 to the controller control portion 302, the job information is then transmitted to the engine control portion 303 and the option control portion 304. The option control portion 304 suggests a plurality of sheet discharging methods executable based on information about the stacking state of each sheet storage portion stored in the memory 340 and the job information. Information on the plurality of sheet discharging methods is transmitted to the external apparatus 301 via the controller control portion 302, and, then, the plurality of sheet discharging methods is displayed on the screen of the external apparatus 301, thus prompting the user to make a selection. When the user selects one of the plurality of sheet discharging methods, a result of the selection is transmitted to the option control portion 304 via the controller control portion 302, and, at the same time, an instruction to start printing is issued to the engine control portion 303. During execution of the printing, the option control portion 304 distributes sheets into the associated sheet storage portions according to the selected sheet discharging method. When all of the sheets have been stored, the option control portion 304 transmits a storage completion notification to the external apparatus 301, thus notifying the user that the sheets have become ready to be discharged. In the process of selecting a sheet discharging method, operations except that a plurality of sheet discharging methods and a result of selection are not transmitted to the engine control portion 303 are similar to those in the first exemplary embodiment.

In the above-described first and second exemplary embodiments, a case has been described in which the number of sheets used for printing of a job for the user B exceeds the upper limit number of sheets allowed to be stored in one sheet storage portion (for example, ten sheets). Although not mentioned in the first and second exemplary embodiments, such a configuration may be used as to allow the user to select a sheet discharging method only when the user has issued an instruction to perform a print job in which the number of sheets used for printing exceeds the upper limit number of sheets allowed to be stored in one sheet storage portion. In other words, in a case where the number of sheets used for printing is equal to or less than the upper limit number of sheets allowed to be stored in one sheet storage portion, the sheets are automatically conveyed to one vacant sheet storage portion. This can save the user's trouble of selecting a sheet discharging method each time the user issues a print instruction.

Furthermore, such a configuration may be used as to allow the user to select a sheet discharging method not only in a case where the number of sheets used for printing exceeds the upper limit number of sheets allowed to be stored in one sheet storage portion but also in a case where sheets cannot be distributed according to ordinarily set distribution methods (storing methods). For example, in a state in which a job-by-job distribution method of storing sheets in different sheet storage portions for respective job numbers is normally set, a case can be considered where the user has issued instructions to perform printing a number of times that is greater than the number of vacant sheet storage portions. Here, the ordinal numbers in the number of times of instructions for printing respectively correspond to the job numbers.

Moreover, on the other hand, such a configuration may be used as to allow the user to select a sheet discharging method each time the user issues a print instruction. In the first and second exemplary embodiments, the user may be allowed to select a sheet discharging method even in a case where the number of sheets used for printing a job for the user B falls within the number of sheets allowed to be stored in one sheet storage portion. For example, a job for the user B is a print request with four sheets by two copies (eight sheets in total), since the number of sheets used for printing falls within the number of sheets allowed to be stored in one sheet storage portion, the sheets do not necessarily need to be stored in a plurality of sheet storage portions. However, even in such a case, allowing the user to distribute and discharge the sheets according to the user's preference can improve usability.

Additionally, in the above-described first and second exemplary embodiments, a case has been described in which the sheets for the user A have already been stored in the sheet storage device 200 when the user B issues a print instruction. However, naturally, the sheets for the user A do not need to have already been stored in the sheet storage device 200.

Also in the above-described first and second exemplary embodiments, the display and selection of sheet discharging methods are performed on the screen of the external apparatus 301. However, the same or similar information may also be displayed on the operation panel, serving as the information display unit 310, to allow the user to select and confirm a desired sheet discharging method via the operation panel.

Furthermore, in the above-described first and second exemplary embodiments, since the sheet movement units for the respective sheet storage portions are provided with the respective individual actuators, simultaneously driving the actuators enables sheets stored in a plurality of sheet storage portions to be exposed in a lapped manner. On the other hand, only a number of actuators that is less than the number of sheet storage portions may be provided. For example, if a drive transmission switching unit, such as a clutch (not illustrated), is provided, a single actuator may be used to selectively move a plurality of sheet movement units.

Moreover, in the above-described first and second exemplary embodiments, the memory 340 is included in the option control portion 304. However, the memory 340 may be included in the controller control portion 302 or the engine control portion 303. Alternatively, the memory 340 may be independently provided inside the image forming apparatus 100.

In addition, in the above-described first and second exemplary embodiments, the engine control portion 303 and the option control portion 304 are separately configured. However, the engine control portion 303 and the option control portion 304 may be integrated into a single engine control portion 303. In such a case, the engine control portion 303 may control the conveyance unit 105 and the sheet storage device 200.

Furthermore, in the above-described first and second exemplary embodiments, a configuration has been described in which the conveyance paths for sheets are confluent on the downstream side of each sheet storage portion and only one opening is arranged. However, a plurality of openings may be arranged. Then, sheets stored in the respective sheet storage portions may be exposed via the respective different openings.

Moreover, in the above-described first and second exemplary embodiments, a configuration has been described in which three sheet storage portions are arranged. However, the number of sheet storage portions is not limited to three. The number of sheet storage portions may be set according to the environment under which the image forming apparatus 100 is used, the number of users who use the image forming apparatus 100 in common, or the specification of the image forming apparatus 100.

Also in the above-described first and second exemplary embodiments, an example has been described in which the sheet storage device 200 is mounted integrally with the image forming apparatus 100. On the other hand, the sheet storage device 200 may be mounted in such a way as to be attachable to and detachable from the image forming apparatus 100 or in such a way as to be simply attachable to the image forming apparatus 100. In such a case, a control portion provided in the image forming apparatus 100 may control an operation of the sheet storage device 200. Alternatively, an independent control portion may be provided in the sheet storage device 200, which controls an operation of the sheet storage device 200 while communicating with a control portion provided in the image forming apparatus 100.

Furthermore, in the above-described first and second exemplary embodiments, a laser beam printer is used as an example of the image forming apparatus 100. However, the image forming apparatus 100 is not limited to being a laser beam printer, but may be a printer using any another printing method, such as an inkjet printer or a copying machine.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application No. 2014-149482 filed Jul. 23, 2014, which is hereby incorporated by reference herein in its entirety.

What is claimed is:

1. An image forming apparatus comprising:

an apparatus body formed with an opening;

an image forming portion configured to form an image on a sheet;

a conveyance unit configured to convey the sheet on which the image has been formed by the image forming portion;

a storage portion configured to store, inside the apparatus body, the sheet conveyed by the conveyance unit;

a sheet movement unit configured to move the sheet stored in the storage portion until the sheet is exposed outside of the apparatus body via the opening;

a memory portion configured to store first information about a storing state of the storage portion; and a control portion configured to receive an image forming instruction to perform image formation on a predetermined number of sheets, wherein, in a case where the predetermined number of sheets is greater than an upper limit number of sheets allowed to be stored in the storage portion when the image forming instruction is received, the control portion provides notification of a plurality of methods, each for causing the sheet moving unit to expose the predetermined number of sheets which are objects of the image forming instruction outside of the apparatus body via the opening, based on the first information stored in the memory portion and second information about the sheets which are the objects of the image forming instruction, and controls the conveyance unit and the sheet movement unit based on a method selected from among the plurality of methods, and wherein, in a case where the predetermined number of sheets is less than or equal to the upper limit number of sheets, the control portion does not provide notification of the plurality of methods and controls the conveyance unit in such a way as to convey the predetermined number of sheets to the storage portion.

2. The image forming apparatus according to claim 1, wherein the control portion notifies an external apparatus connected to the image forming apparatus via a communication unit of the plurality of methods based on the first information and the second information, and controls the conveyance unit and the sheet movement unit based on the method selected via the external apparatus.

3. The image forming apparatus according to claim 1, further comprising an information display unit configured to display information about the image forming apparatus, wherein the control portion causes the information display unit to display the plurality of methods based on the first information and the second information, and controls the conveyance unit and the sheet movement unit based on the method selected via the information display unit.

4. The image forming apparatus according to claim 1, wherein the sheet movement unit moves the sheet until a leading edge of the stored sheet passes through the opening and the sheet becomes exposed outside of the apparatus body via the opening, and stops the sheet in an exposed state in which a part of the sheet is located inside the apparatus body and the other part of the sheet is exposed outside of the apparatus body.

5. The image forming apparatus according to claim 4, further comprising a detection unit configured to detect presence or absence of the sheet moved by the sheet movement unit and stopped in the exposed state, wherein the storage portion includes a first storage portion and a second storage portion that is different from the first storage portion, and wherein the image forming instruction is an instruction to perform image formation on a predetermined number of copies of sheets, the plurality of methods including:

a first discharging method in which, after the conveyance unit conveys a first copy of sheets from among the predetermined number of copies to the storage portion, the sheet movement unit moves the first copy of sheets according to a discharging instruction and stops the first copy of sheets in the exposed state; and after the detection unit detects that the first copy of sheets has been removed, the conveyance unit conveys a second copy of sheets, different from the first copy of sheets, to the storage portion and the sheet movement unit moves the second copy of sheets and stops the second copy of sheets in the exposed state, and a second method in which the conveyance unit conveys the first copy of sheets to the first storage portion and conveys the second copy of sheets to the second storage portion, and the sheet movement unit moves the first copy of sheets and the second copy of sheets according to a discharging instruction and stops the first copy of sheets and the second copy of sheets in the exposed state.

6. The image forming apparatus according to claim 1, wherein, in a case where a method selected by a first user from among the plurality of methods causes a change in a method for sheets for a second user stored in the storage portion, the control portion notifies the second user of the changed method.

7. The image forming apparatus according to claim 4, wherein the first information includes information indicating whether any sheet is stored in the storage portion, information about a number of sheets stored in the storage portion, and information about a user who has issued an instruction to perform image formation on a sheet stored in the storage portion.

8. The image forming apparatus according to claim 4, wherein the second information includes information about a number of sheets which are the objects of the image forming instruction, information about a user who has issued the image forming instruction to perform image formation, information about a job number corresponding to the sheets which are the objects of the image forming instruction, and information about a number of copies included in sheets which are the objects of the image forming instruction.

9. An image forming apparatus comprising:

an apparatus body formed with an opening;

an image forming portion configured to form an image on a sheet;

a conveyance unit configured to convey the sheet on which the image has been formed by the image forming portion;

a storage portion configured to store, inside the apparatus body, the sheet conveyed by the conveyance unit;

a sheet movement unit configured to move the sheet stored in the storage portion until the sheet is exposed outside of the apparatus body via the opening;

a memory portion configured to store first information about a storing state of the storage portion; and a control portion configured to receive an image forming instruction to perform image formation on a sheet, wherein, in a case where a sheet which is an object of the image forming instruction is not able to be conveyed to the storage portion according to a predetermined storing method, the control portion provides notification of a plurality of methods, each for causing the sheet moving unit to expose the sheet which is the object of the image forming instruction outside of the apparatus body via the opening, based on the first information stored in the memory portion and second information about the sheet which is the object of the image forming instruction, and controls the conveyance unit and the sheet movement unit based on a method selected from among the plurality of methods, and wherein, in a case where the sheet which is the object of the image forming instruction is able to be conveyed to the storage portion according to the predetermined storing method, the control portion does not provide the notification of the plurality of discharging methods and controls the conveyance unit in such a way as to convey the sheet which is the object of the image forming instruction according to the predetermined storing method.

* * * * *